United States Patent [19]

Stone et al.

[11] 4,328,971

[45] May 11, 1982

[54] DARTBOARD

[75] Inventors: James H. Stone; Stephen H. Stone, both of Lincolnshire, England

[73] Assignee: Dunlop Limited, London, England

[21] Appl. No.: 140,749

[22] Filed: Apr. 16, 1980

[30] Foreign Application Priority Data

May 3, 1979 [GB] United Kingdom ..... 7915499
Jul. 5, 1979 [GB] United Kingdom ..... 7923452

[51] Int. Cl.[3] ..... F41J 3/00
[52] U.S. Cl. ..... 273/408
[58] Field of Search ..... 273/403, 404, 408

[56] References Cited

U.S. PATENT DOCUMENTS 2,060,405 11/1936 Widmeier ..... 273/403
3,409,301 11/1968 Studen .
4,101,126 7/1978 Kurtz et al. ..... 273/408

FOREIGN PATENT DOCUMENTS 26680 of 1911 United Kingdom ..... 273/403
3 81844 10/1932 United Kingdom ..... 273/408
481943 3/1938 United Kingdom ..... 273/404
508706 7/1939 United Kingdom .
644250 10/1950 United Kingdom ..... 273/408
942332 11/1963 United Kingdom .
2019230 10/1979 United Kingdom ..... 273/408

*Primary Examiner*—Paul E. Shapiro
*Attorney, Agent, or Firm*—Stevens, Davis, Miller & Mosher

[57] ABSTRACT

Conventional dartboard wiring grids and their attachment structures obscure a significant proportion of the target areas. The invention aims to provide an improved definition of target areas by using fine high tensile wires for the grid. The grid is formed in such a manner that the fine wires are not easily bent on impact but can be easily replaced should they become bent. The grid (11) has straight high tensile radial wires (17) running from an inner ring (20) to an outer ring, endless high tensile wires (18,19) defining doubles and trebles and a plurality of pegs (18*c,* 18*d,* 19*c* 19*d*) projecting in concentric circles from the board, the endless wires being held in tension around the circles of pegs. The endless wires preferably overlie the radial wires and are held clear of the dartboard surface.

11 Claims, 6 Drawing Figures

DARTBOARD

This invention relates to dartboards and is particularly concerned with providing a dartboard of high quality, particularly suitable for match play.

The conventional dartboard is formed of bundles of sisal fibres compressed together and glued with the fibres end on to a circular back board and all enclosed within a metal band, the target areas being defined by a wire grid stapled to the compressed fibres and consisting of twenty straight round wires radiating from the outer of a pair of concentric central round wire circles (defining the "bull's eye" or "bull" and a surrounding area of lesser value or "outer bull") and intersecting further pairs of round wire circles (defining the "treble" and "double" areas of the twenty sectors of the remaining playing area) and the values (i.e. numbers) of the sectors being defined by round wire numerals attached to a wire rim adjacent the edge of the dartboard and also stapled to the compressed fibres (e.g. by over 60 staples).

Although the wires are comparatively small in diameter, nevertheless, because they have to be of adequate strength, they (and the staples securing them) obscure a significant proportion of the target areas and the surrounding "non-playing" area, and thus present obstruction to darts, which not infrequently strike the wires, become damaged, and bounce off (thereby not contributing to the score and possibly—and more importantly—becoming unfit for further use), and the wires soon become deeply embedded in the said fibres and possibly also bent, so that the target areas become of unequal size and unclear to a player at a position from which the darts are required to be thrown.

In a matter of days a dartboard can become unfit for match play, and in a matter of weeks completely unfit for any serious use. The time within which a dartboard becomes unfit for use is always also shortened by concentration of darts on one particular target area (e.g. the "20" sector) and rotation of the wire rim to relocate the wire numerals (with appropriate rotation of the whole board to restore the spatial disposition of the numbers) affords only a very temporary prolongation of the life of the board.

One object of the invention is to provide a dartboard with very clear and accurate definition of the target areas.

Another object is to provide means for defining the target areas which greatly reduces the possibility of any dart on target not entering an area and bouncing back.

A further object is to provide means for defining the target areas which cannot cause damage to darts or be damaged by darts.

With these objects in view it has been previously proposed to provide a dartboard with a grid of strip-like partitions defining the target areas, with each partition formed with a "knife-edge" presented at the surface of the compressed fibres. The expression "knife-edge" does not denote an edge capable of cutting but one with no appreciate surface area parallel to the surface of the compressed fibres, and each "knife-edge" was proposed to be very slightly rounded, so as not to present a thin edge that can be burred over by impact from the leading end of the body of a dart overdriven into the board. In order to mount the grid on the dartboard without using staples it was proposed to press it into the compressed fibres until only about 1.5 mm of some 6 mm protruded, the opposite edges of the partitions also being "knife-edges" (as described above) to assist in the embedding of the grid into the compressed fibres.

However, the proposed grid as described above proved to have certain disadvantages, the most notable being that the increase in the compression of the fibres resulting from the pressing in of the grid, especially in the smaller areas made it progressively more difficult for darts to enter the board as the fibres became bent by darts entering the board. Attempts have been made to overcome this difficulty by grooving the dartboard to receive the grid or by forming the dartboard in sections or segments to fit within the grid, but these solutions call for considerable accuracy in the positions and sizes of the grooves or the shapes of the sections or segments, thus adding appreciably to the cost of production. Another approach has been to try a wide variety of different materials in place of the sisal fibres, such as wood, cork, "Plasticine" (registered Trade Mark), and expanded polyethylene, but none has shown any worthwhile improvement over sisal fibres.

It has also been proposed to use polypropylene filaments in place of sisal fibres but while the indication is that a dartboard of polypropylene filaments will be more durable than one made of sisal fibres, all the aforementioned difficulties attendant upon trying to fit a grid of strip-like partitions into a dartboard of sisal fibres are again encountered when trying to fit such a grid into a dartboard of polypropylene filaments.

More recently, it has been proposed to form a grid of straight high tensile radial wires with bent ends pushed into the dartboard adjacent an inner ring (denoting the outer limit of the "outer bull") and beyond an outer ring which encloses the playing area, and arcuate high tensile wires with bent ends pushed into the dartboard adjacent the radial wires to define the rings of the target areas (the "trebles" and "doubles") within the sectors defined by the radial wires.

While this enables the radial and arcuate wires to be formed of very fine high tensile wire (such as diamond drawn stainless steel wire) so as to clearly and accurately define the target areas, with considerably reduced risk of a dart hitting a wire and bouncing back, when a wire is hit by a dart the wire may well be bent to such an extent that it needs to be removed from the board and straightened when bent or replaced by a fresh wire with similar bent ends for pushing into the board.

The extent to which an arcuate wire could be bent when hit by a dart may be reduced by overlapping the arcuate wires by pushing their bent ends into the board over the radial wires, but while this arrangement also helps to keep the radial wires in place without the need of any conventional staples, it has the disadvantages that the arcuate edges of the target areas are not concentric or are staggered and that when a radial wire is bent it is necessary to remove (and later replace) eight arcuate wires in order to remove the radial wire for straightening or for replacement.

Yet another object of the invention is, therefore, to alleviate the disadvantages of the aforementioned more recent proposal.

According to the present invention, a dartboard has a grid comprising straight high tensile radial wires running between an inner ring and an outer ring which encloses the playing area, a plurality of endless high tensile wires crossing the radial wires, said endless wires defining the rings of the target areas, e.g. the "trebles"

and "doubles" and a plurality of pegs projecting from the playing area of the board and arranged in concentric circles and around which the endless wires are held in tension.

The endless high tensile wires preferably overlie the radial wires and are held slightly clear of the dartboard surface. Thus, although if an endless wire is hit by a dart it is less likely to be bent because it is in tension, it is very easy to remove it for replacement or repair. Also if a radial wire is bent by being hit by a dart, it is a simple matter to remove (and later replace) all the overlying endless wires (usually only four; two for the "trebles" and two for the "doubles") in order to remove the radial wire for straightening or replacement.

Both the radial and endless wires may be formed of very fine high tensile wire (such as diamond-drawn stainless steel or high carbon steel) so as to clearly and accurately define the target areas.

Each radial wire may be provided with a hook at one end engaging the inner ring (which will normally be the ring of the outer bull) and an eye at the other end engaging a peg, preferably appreciably radially beyond the playing area, with all the radial wires in tension between the inner ring and the pegs, so that there is less likelihood also of a radial wire being bent when hit by a dart. A bent radial wire can be unhooked from its peg and the inner ring and slid out from under the endless wires. Alternatively each radial wire may have a hook at each end or an eye at each end or an eye at the inner ring end and a hook at the other end.

The pegs will usually each have one pointed end to be driven into the dartboard and means adjacent the other end at which an endless wire may be located. The location means may be a hook or notch facing radially outwards, for "snap-over" engagement by the endless wires (or the eyes or hooks of the radial wires, as the case may be), thus reducing or eliminating the possibility of a wire being detached from a peg or pegs by "flipping" with a dart point being withdrawn from the board.

In one embodiment the pegs may comprise a circular cross-section, a point at one end, a dome at the other, and a circumferential groove adjacent the domed end.

This type of peg does not require orientation because a portion of the circumferential groove must always be presented radially outwards with respect to the board and be available for "snap-over" engagement by an endless wire or the eye of a radial wire. Furthermore, it can be driven through a round hole in a jig and, as is described below, the pegs are preferably located in the board by jig means.

The domed end of this type of peg assists the "snap-over" engagement, but its primary purpose is to deflect any dart point hitting it so that the dart point enters the board adjacent to the peg rather than the dart bouncing back, and the domed end is—therefore—preferably somewhat more pointed than hemispherical, e.g. like the "sharper" end of an egg.

The groove of this type of peg is preferably partcircular in cross-section, and is preferably at least 0.9 mm in diameter but only 0.5 mm deep, so as to be able to receive wire of 0.9 mm diameter or less. The peg is preferably about 35 to 40 mm long and 2.5 mm diameter, with a point about 4 mm long and with the domed end extending up to 2 mm beyond the groove.

Non-circular pegs may be of similar length and preferably flat-bodied of dimensions say about 3 mm wide and less than 1 mm thick.

The pegs for the endless wires are preferably disposed closely adjacent to and on alternate sides of the radial wires, so as to assist in setting and maintaining corrent radial alignment of the radial wires. Alternatively, or in addition, either the endless wires or the radial wires may be kinked where they overlie each other, bringing the intervening portions of the endless wires into close proximity to the surface of the playing area of the board, without loss of tension in the endless wires.

Hooked or notched pegs are preferably formed from non-circular section steel, e.g. hardened and tempered spring steel, to facilitate correct orientation of the hooks so that the pegs can be jig-located for driving into a backing board of the dartboard, and the hooked or notched ends may be domed to deflect darts which may hit them.

As indicated above, the pegs are preferably located in the board by means of a suitable jig. The jig preferably consists of three plates stacked vertically on top of the board before the grid wires are applied. The pegs are located in appropriate holes through the stack and pressed into the board by means of, for example, a fly-press. The top and middle plates of the jig are successively removed each after a pressing operation so that the pegs are pressed by degrees until they protrude to the desired final height, which corresponds to the thickness of the lower plate. The lower plate is then removed and the pegged board is ready to receive the radial and endless wires. A three-part jig is not essential and more or less plates may be used but three plates have been found to give adequate support to the pegs as they are being driven in. However many plates are used, they will be provided with sighting holes that can be aligned with the boundaries between the differently coloured adjacent target sectors that are conventionally provided on a dartboard so that accurate location of the pegs can be achieved.

Once the pegs are positioned in the board, the wires are attached. This is preferably done as follows. First the outer bull ring is placed around its ring of pegs. Then the radial wires are fitted, one end of eachhooking inside the outer bull ring and the other end of each fitting over the outside ring of pegs. When all the radial wires are attached, the concentric endless rings to define the doubles and trebles are fitted over their respective pegs. Finally the inner bull ring is stapled in the center of the outer bull ring. The numerals are then attached outside the outer doubles ring.

In addition to greatly simplifying the provision of a grid on a dartboard and maintenance of it, as compared with using arcuate wires with bent ends, the use of endless wires also allows their being replaced by endless wires of a different gauge, e.g., a wire of lesser diameter (say 0.6 to 0.7 mm) for match play and a greater wire diameter (say 0.9 mm) for practice or other play, but generally between 0.5 mm and 1 mm. The radial wires may be of similar diameter and preferably may be from 0.6 to 0.7 mm.

As indicated above, a bull may also be defined by a wire ring, which may be secured by two or more conventional staples or may be formed with two or more integral points for pushing into the board, so as to be removable for "straightening" or replacement.

The values of the sections may be defined by round wire numerals attached to a wire rim adjacent the edge of the dartboard and detachably secured thereto, to permit rotation of the wire rim to relocate the wire numerals (with appropriate rotation of the whole board to restore the spatial disposition of the numbers) more especially the "20" against a lesser worn sector, and the wire numerals may be formed of wire of conventional thickness, e.g. 0.1 inch (2.54 mm) diameter, or thinner wire, e.g. 0.036 inch (0.91 mm) diameter. Alternatively, the values of the sectors may be defined by integral numbers of a plastics ring detachably secured adjacent the edge of the dartboard and preferably formed of a material into which a dart point can penetrate and be held, rather than the dartbounding off with risk of damage to the point through hitting the floor.

The back of the dartboard is preferably provided with secure means for detachably mounting the board on a wall or in a wall fitting, with ability to be rotated when necessary, but not otherwise.

Embodiments of the invention are now illustrated by way of example only by reference to the accompanying drawings in which.

Figure 1:
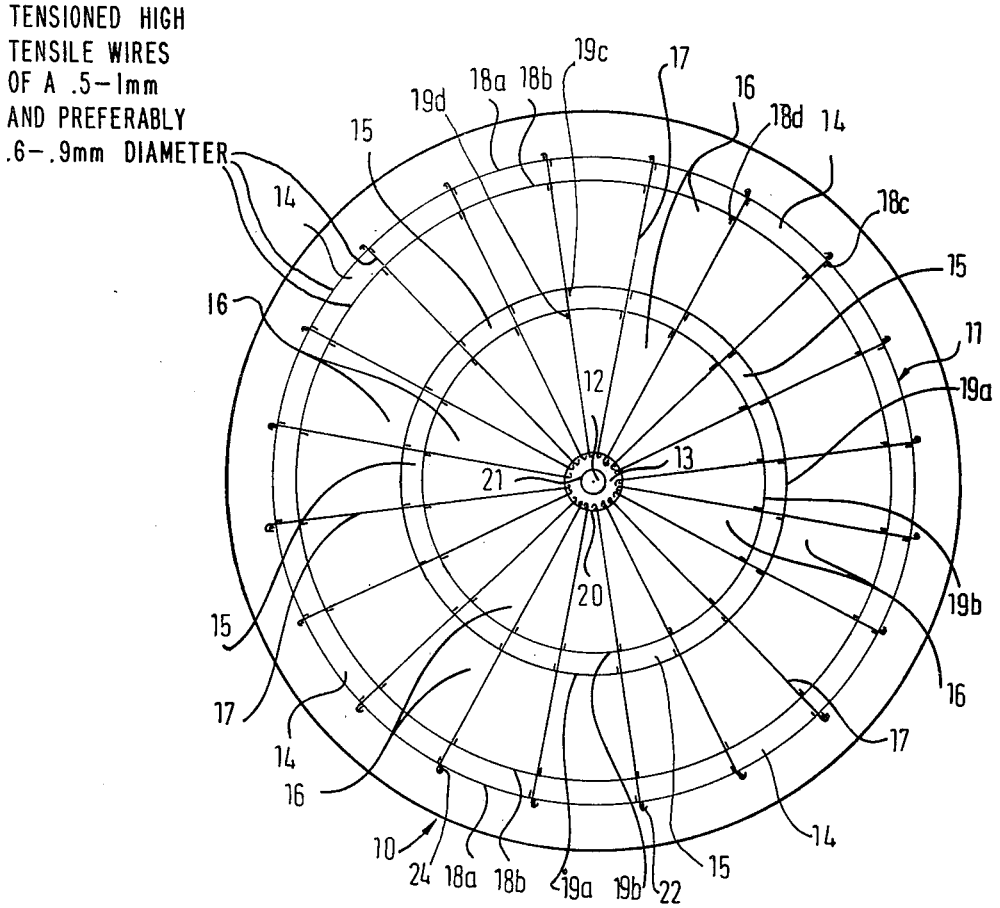
FIG. 1 is a plan view of a dartboard of the invention without value numbers.

In FIG. 1, dartboard 10 has a grid 11 defining the target areas. The target areas are the inner bull 12, outer bull 13, doubles 14, trebles 15 and singles 16. These areas are defined by straight radial wires 17, concentric double wires 18*a* and 18*b* and concentric treble wires 19*a* and 19*b*. Each double and treble wire is a continuous wire defining a circle on the target face of the dartboard. Each double wire 18*a* and 18*b* and treble wire 19*a*, and 19*b* is held in its position in tension by a concentric ring of pegs 18*c*, 18*d*, 19*c* and 19*d* respectively. Pegs 18*c*, *d* and 19*c*, *d* have been driven into the target face of the dartboard until they protrude just sufficiently to hold their respective concentric wires 18*a*, 18*b*, 19*a*, 19*b* sufficiently clear of the dartboard surface for the concentric wires to overlie the radial wires 17.

Figure 2:
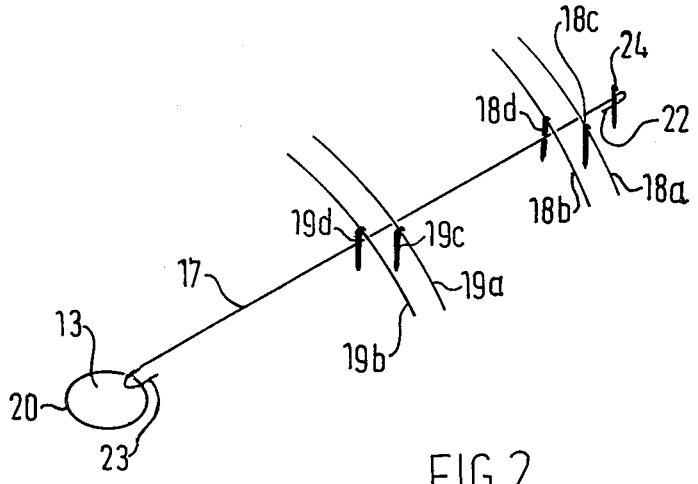
FIG. 2 is a representation in exploded form of a portion of the wire grid of FIG. 1.

As can be seen from the exploded partial view of the grid 11 in FIG. 2, each radial wire 17 has a hook 23 at its inner end formed by bending over the end of the wire. Hook 23 is hooked around ring 20 of the outer bull 13. The outer end of each radial wire is also bent back on itself to form a hook 22 which is held in place by a further peg 24 and ring 20 hold radial wire 17 in tension. (If desired either or both of the ends of the wire could instead be bent at right angles instead of or additionally to the hook formation to form a leg which can be pressed into the board.

Endless concentric wires 18*a*, 18*b*, 19*a* and 19*b* overlie radial wire 17 and are held in position as tensioned rings by their respective pegs 18*c*, 18*d*, 19*c* and 19*d*.

Figure 3A:
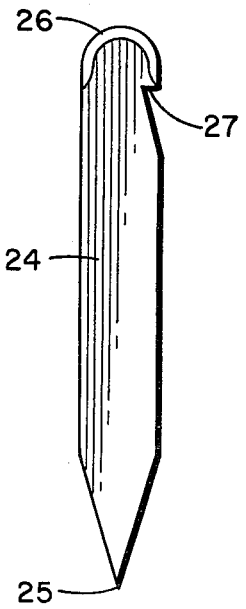
FIGS. 3A, 3B are two views of a flat peg for use in the board of FIG. 1; and, FIGS. 4A, 4B are two views of an alternative peg for use in the board of FIG. 1.
Figure 3B:
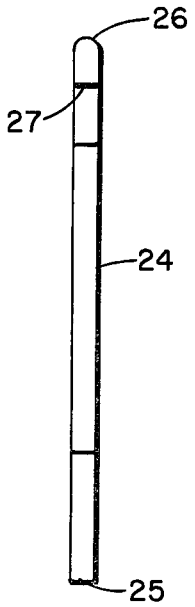
Figure 4A:
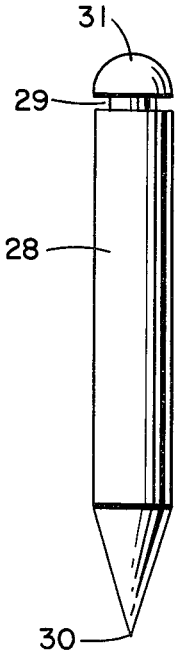
Figure 4B:
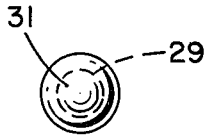

FIGS. 3A, 3B show a slightly enlarged view of a typical flat peg 24. It has a pointed end 25 to be driven into the dartboard. Its other end 26 has a generally domed shape. Adjacent end 26 a notch 27 is formed in the peg. This notch serves to locate the hooked end 22 of a radial wire. Pegs 18*c*, 18*d*, 19*c* and 19*d* are similarly formed, their noches 27 serving to locate the concentric doubles and trebles rings wires. It will be seen that pegs 18*c* and 18*d* and similarly 19*c* and 19*d* are disposed closely adjacent to and on alternate sides of radial wires 17. As an alternative peg, a circular cross section peg 28 having a circumferential groove 29, a pointed end 30 and a rounded end 31, such as shown in FIGS. 4A, 4B may also be used to hold the wires.

Having now described our invention what we claim is:

1. A dartboard having a grid comprising straight high tensile radial wires, an inner ring and an outer ring which enclose the playing area of the dartboard, said radial wires running from the inner ring to the outer ring, a plurality of endless tensile wires crossing the radial wires, said endless wires defining the rings of the target areas of the dartboard, and a plurality of pegs projecting from the playing area of the dartboard and arranged in concentric circles and around which the endless wires are held in tension.

2. A dartboard according to claim 1, in which the endless wires overlie the radial wires and are held clear of the dartboard surface.

3. A dartboard according to claim 1, in which each radial wire is held in tension with its outer end secured to a further peg.

4. A dartboard according to claim 1, in which the pegs have a pointed end to be driven into the dartboard and means adjacent their other end to locate one of said wires.

5. A dartboard according to claim 4, in which the means is a hook or notch facing radially outwardly of the board.

6. A dartboard according to claim 5, in which the pegs are flat-bodied.

7. A dartboard according to claim 4, in which the pegs are of circular cross-section and the means is a circumferential groove.

8. A dartboard according to any one of the preceding claims 1 to 7, in which the pegs are domed at their projecting end.

9. A dartboard according to any one of claims 1 to 7, in which the pegs around which the endless wires are held are closely adjacent to and on alternate sides of the respective radial wires.

10. A dartboard according to any one of claims 1 to 7, in which the endless and radial wires have diameters in the range 0.5 mm to 1.0 mm.

11. A dartboard according to claim 10, in which the endless and radial wires have diameters from 0.6 to 0.9 mm.

* * * * *